US008641037B2

(12) United States Patent
Tokuda

(10) Patent No.: US 8,641,037 B2
(45) Date of Patent: Feb. 4, 2014

(54) SHEET FEEDING DEVICE AND IMAGE FORMING APPARATUS HAVING THE SAME

(75) Inventor: Hiroshi Tokuda, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/814,543

(22) Filed: Jun. 14, 2010

(65) Prior Publication Data

US 2011/0062660 A1 Mar. 17, 2011

(30) Foreign Application Priority Data

Sep. 14, 2009 (JP) ..... 2009-211992

(51) Int. Cl.
*B65H 1/00* (2006.01)

(52) U.S. Cl.
USPC ..... 271/162; 271/258.01

(58) Field of Classification Search
USPC ..... 271/162, 110, 258.01, 258.02, 265.01, 271/265.02, 25, 31, 130, 37
See application file for complete search history.

(56) References Cited

U.S. PATENT DOCUMENTS 3,827,687 A * 8/1974 Kono ..... 271/117
4,469,320 A * 9/1984 Wenthe, Jr. ..... 271/98
4,572,580 A * 2/1986 Bieri ..... 299/1.5
5,897,112 A * 4/1999 Kwag ..... 271/38
6,076,818 A * 6/2000 Oda ..... 271/3.04
2007/0057437 A1* 3/2007 Nishitani et al. ..... 271/162
2009/0129790 A1* 5/2009 Kang ..... 399/23

FOREIGN PATENT DOCUMENTS

JP 61-238633 A 10/1986
JP 62181543 U 11/1987
JP 6-144641 A 5/1994
JP 7-076439 A 3/1995
JP 10291687 A 11/1998

OTHER PUBLICATIONS

Notice of Reasons for Rejection, issued Feb. 26, 2013, in corresponding Japanese Patent Application No. 2009-211992.

* cited by examiner

*Primary Examiner* — Thomas Morrison
(74) *Attorney, Agent, or Firm* — Banner & Witcoff, Ltd.

(57) ABSTRACT

A sheet feeding device for use in an apparatus body of an image forming apparatus may include a sheet holder configured to be removed from and attached to the apparatus body and to hold a stack of sheets therein; an actuator including a base portion pivotally attached to the apparatus body via a first shaft and a movable portion pivotally attached to the base portion via a second shaft and extending toward the sheet holder; and a detector configured to detect a position of the base portion. The actuator may be configured such that the base portion and the movable portion pivot in response to the detector detecting the position of the base portion. The movable portion may be configured to pivot in a removal direction in which the sheet holder is removed from the apparatus body.

19 Claims, 8 Drawing Sheets

SHEET FEEDING DEVICE AND IMAGE FORMING APPARATUS HAVING THE SAME

CROSS REFERENCE TO RELATED APPLICATION

This application claims priority from Japanese Patent Application No. 2009-211992, filed on Sep. 14, 2009, the entire subject matter of which is incorporated herein by reference.

FIELD

Aspects of the disclosure relate to a sheet feeding device and an image forming apparatus having the sheet feeding device.

BACKGROUND

A known image forming apparatus, e.g., a printer, includes a sheet feeding device. The sheet feeding device typically includes a sheet cassette for storing recording sheets, e.g., plain paper and transparency sheets, which is detachable from a body casing of the image forming apparatus, and an actuator lever for detecting the presence or absence of a recording sheet in the sheet cassette. The actuator lever is pivotally coupled to the body casing.

The actuator lever is configured to pivotally move such that a distal end portion (lower end portion) of the actuator lever lowers and approaches a bottom portion of the sheet cassette in response to reduction of the number of recording sheets stored in the sheet cassette. The image forming apparatus detects the presence or absence of a recording sheet by detecting the position of the actuator lever.

However, if the sheet cassette is removed from the body casing with the distal end portion of the actuator lever remaining in a lower position and if the size of a sheet in the sheet cassette does not match the size of sheet that the sheet cassette is set to hold, the sheet cassette or a sheet stored in the sheet cassette may collide with the actuator lever and cause the actuator lever to be damaged.

To minimize such damage to the actuator lever, the distal end portion of the actuator lever may be formed with a guide surface inclined in a direction where the sheet cassette is removed. When the sheet cassette is removed from the body casing, the stack of recording sheets stored in the sheet cassette may be forced to collide against the inclined guide surface, causing the actuator lever to pivot in such a manner as to allow the sheet cassette to be withdrawn.

SUMMARY

However, as the inclined guide surface is inclined from the distal end portion of the actuator lever with respect to a line parallel to the direction where the sheet cassette is removed or a horizontal line, the actuator lever is likely to increase in size in the direction where the sheet cassette is removed.

Aspects of the disclosure provide a sheet feeding device configured to minimize damage to an actuator lever and reduce in size.

BRIEF DESCRIPTION OF THE DRAWINGS

Illustrative aspects will be described in detail with reference to the following figures in which like elements are labeled with like numbers and in which.

DETAILED DESCRIPTION

Figure 1:
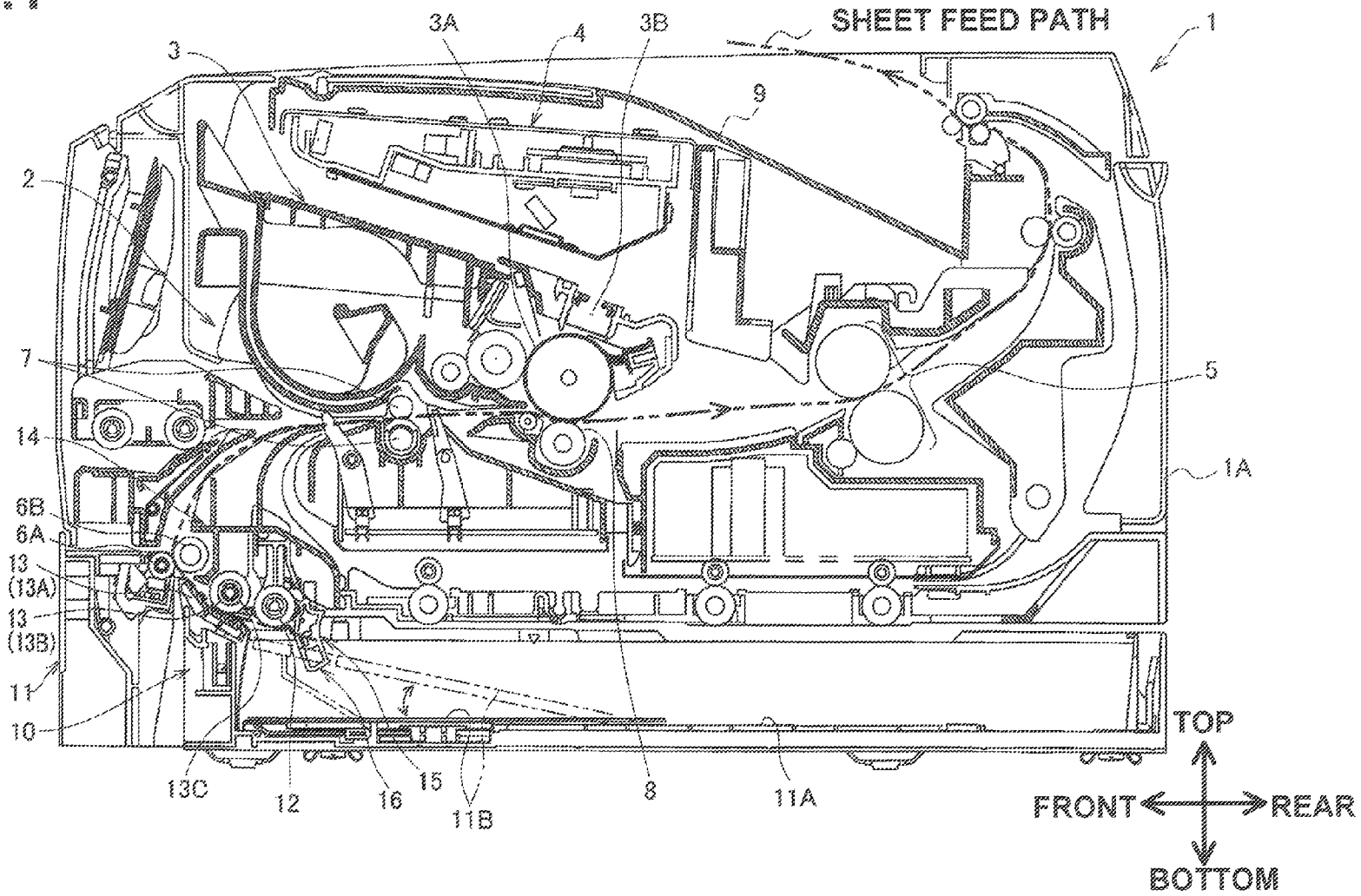
FIG. 1 is a central cross sectional view of an example of an image forming apparatus using features described herein.

An illustrative embodiment will be described in detail with reference to the accompanying drawings. A sheet feeding device according to illustrative aspects of the disclosure is employed in an image forming apparatus 1 as shown in FIG. 1.

A general structure of the image forming apparatus 1 will be described with reference to FIG. 1.

For ease of discussion, in the following description, the top or upper side, the bottom or lower side, the left or left side, the right or right side, the front or front side, and the rear or rear side are used to define the various parts when the image forming apparatus 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

The image forming apparatus 1 includes an image formation portion 2 and a sheet feeder 10. The image formation portion 2 is configured to form an image on a recording sheet, e.g., plain paper and a transparency sheet. The sheet feeder 10 is configured to feed a recording sheet to the image formation portion 2.

The image formation portion 2 includes a process cartridge 3, an exposure unit 4, and a fixing unit 5. The process cartridge 3 stores a photosensitive drum 3A carrying a developer image thereon, and a charger 3B for charging the photosensitive drum 3A.

While a recording sheet is fed from the sheet feeder 10 toward the image formation portion 2, the recording sheet is fed between a dust removing roller 6A and a feed roller 6B to remove dust, fed between a pair of registration rollers 7 to correct skew of the recording sheet, and then fed to the photosensitive drum 3A. The feed roller 6B is configured to press the recording sheet toward the dust removing roller 6A.

The charger 3B charges the photosensitive drum 3A, and the exposure unit 4 exposes the photosensitive drum 3A, so that an electrostatic latent image is formed on the surface of the photosensitive drum 3A. A developing agent, e.g. toner in this illustrative embodiment, is supplied to the photosensitive drum 3A, and a developer image is carried or formed on the surface of the photosensitive drum 3A.

A transfer roller 8 is disposed facing the photosensitive drum 3A. When the sheet passes between the transfer roller 8 and the photosensitive drum 3A, the developer image carried on the surface of the photosensitive drum 3A is transferred onto the recording sheet by an electrical charge of opposite polarity to that of the developing agent, which is applied to the transfer roller 8.

The sheet having the developing agent thereon is heated while it is fed through the fixing unit 5, and the developing agent is thermally fixed onto the sheet. The sheet on which the developer image has been thermally fixed is fed upward and ejected to an output tray 9 disposed on the top surface of the image forming apparatus 1.

A structure of the sheet feeder 10 will be described.

As shown in FIG. 1, the sheet feeder 10 includes a sheet holder such as a sheet supply cassette 11 having a holding portion 11A. The sheet supply cassette 11 is disposed in a lower portion of the image forming apparatus 1, and is configured to hold a stack of sheets therein, and to be attached to and removed from an apparatus body 1A to which the image formation portion 2 is assembled, horizontally, e.g. in a front-rear direction in this embodiment. The apparatus body 1A refers to an apparatus frame or an apparatus casing to which the image formation portion 2 is assembled. The sheet feeder 10 is configured to separate an uppermost sheet from a stack of sheets held in the holding portion 11A and feed the sheet to the image formation portion 2.

In this illustrative embodiment, when the sheet supply cassette 11 is pulled toward the front, it is removed from the apparatus body 1A. When the sheet supply cassette 11 is pushed from the front to the rear, it is attached to the apparatus body 1A. Hereinafter, a direction in which the sheet supply cassette 11 moves from the rear to the front is referred to as a cassette removal direction, and a direction in which the sheet supply cassette 11 moves from the front to the rear is referred to as a cassette attachment direction.

A pickup roller 12 is attached to the apparatus body 1A. The pickup roller 12 is configured to draw the uppermost sheet of the stack of sheets held in the holding portion 11A toward the image formation portion 2 by rotating in contact therewith.

The pickup roller 12 is pivotally attached to the apparatus body 1A via a roller holder (not shown), which is disposed in a central portion of the sheet supply cassette 11 in a width direction thereof. The width direction of the sheet supply cassette 11 refers to a direction perpendicular to a sheet feeding direction of horizontal directions, and coincides with a right-left direction of the image forming apparatus 1 in this illustrative embodiment.

A pressing plate 11B is disposed at a bottom or lower portion of the holding portion 11A. The pressing plate 11B is configured to raise the stack of sheets held in the holding portion 11A toward the pickup roller 12. As the pressing plate 11B moves toward the pickup roller 12, a contact angle of a sheet with respect to the pickup roller 12 is maintained substantially the same.

A separation mechanism 13 is disposed on a downstream side of the pickup roller 12 in a direction where a sheet is fed (hereinafter referred to as a sheet feed direction). The separation mechanism 13 includes a separation pad 13A and a separation roller 13B. The separation pad 13A is configured to contact the sheet fed by the pickup roller 12 and apply a resistance to the sheet. The separation roller 13B is configured to rotate while pressing the sheet toward the separation pad 13A.

Figure 2:
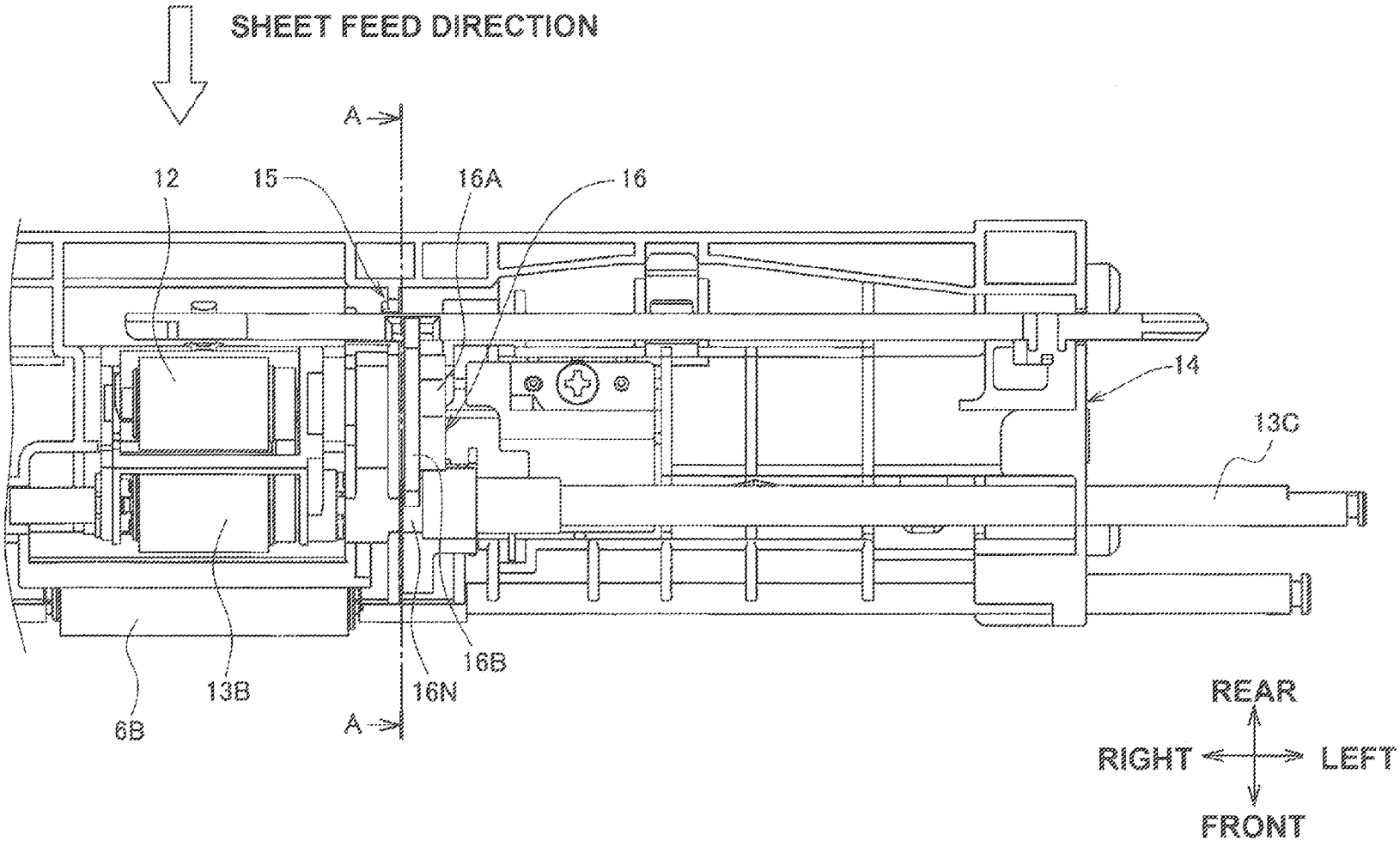
FIG. 2 is a rear view of a guide member according to illustrative aspects of the disclosure.

The separation roller 13B is formed integrally with a shaft 13C and rotates along with the shaft 13C. The separation pad 13A is pivotally attached to a wall portion of the sheet supply cassette 11. The shaft 13C is rotatably attached to a guide member 14 (FIG. 2). The guide member 14 is a part of the apparatus body 1A and is configured to guide the sheet fed by the pick up roller 12.

A sheet detection mechanism (empty sensor) 15 is disposed in the vicinity of the pickup roller 12. The sheet detection mechanism 15 is configured to detect the presence or absence of a sheet held in the holding portion 11A. When the sheet detection mechanism 15 detects that the holding portion 11A is empty, such a message appears on a display (not shown) of the image forming apparatus 1.

A structure of the sheet detection mechanism 15 will be described.

Figure 3B:
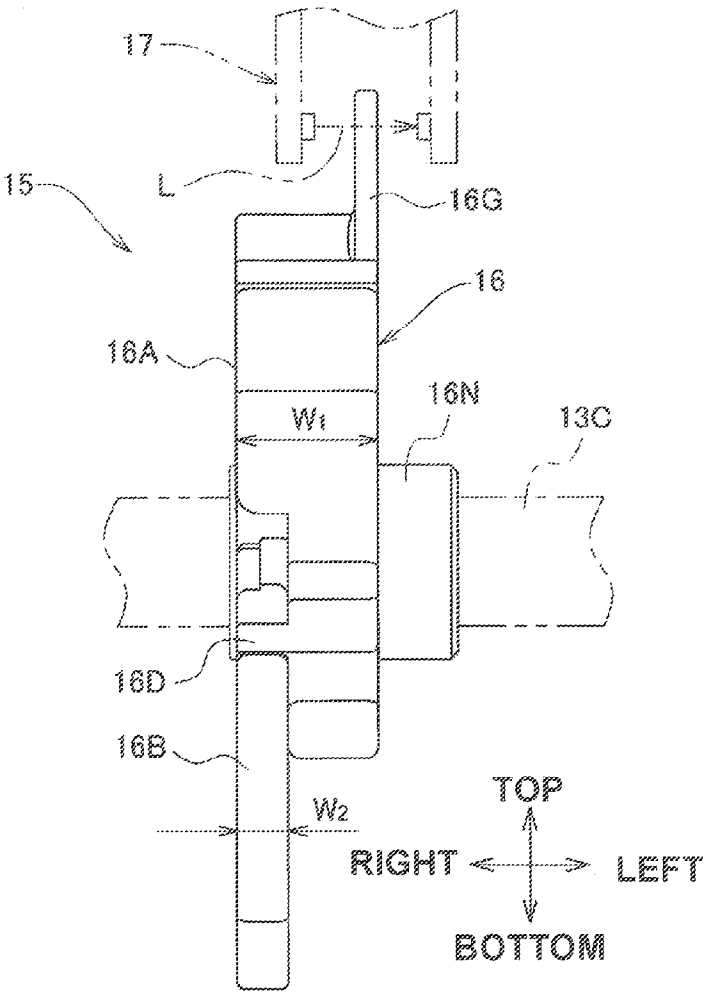
FIG. 3B is a right side view of the actuator.
Figure 3A:
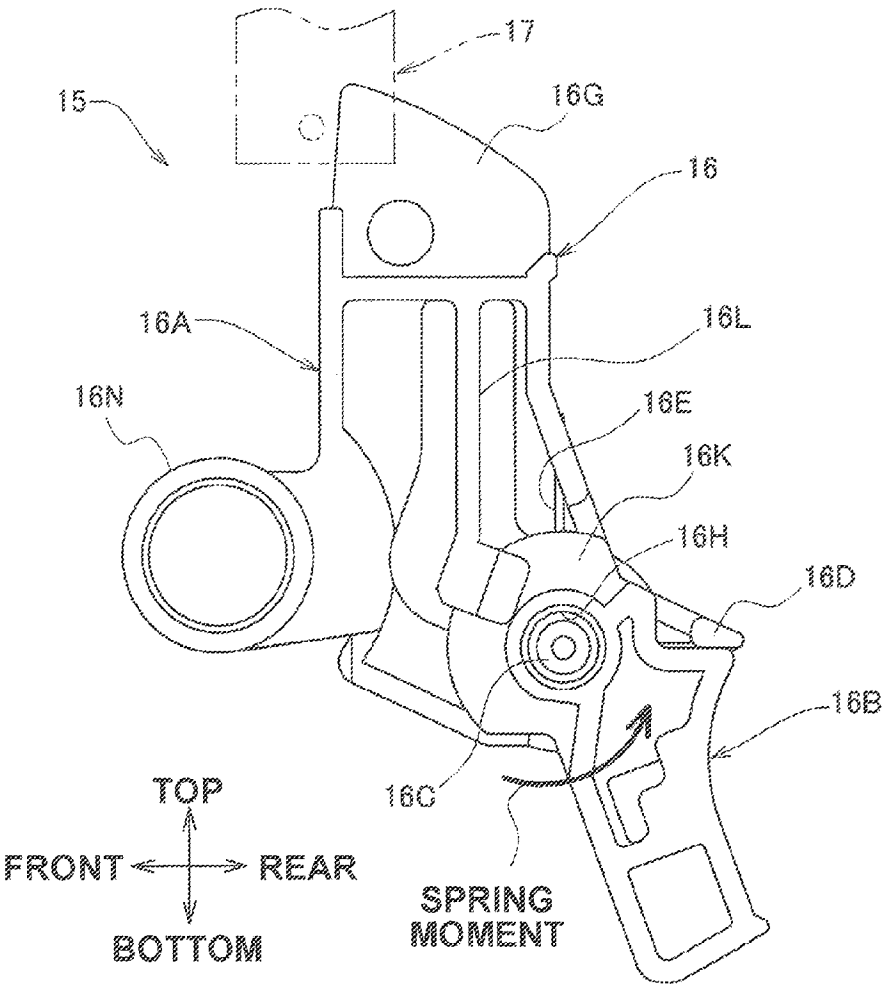
FIG. 3A is a front view of an actuator according to illustrative aspects of the disclosure.

As shown in FIGS. 3A and 3B, the sheet detection mechanism 15 includes an actuator such as an actuator lever 16 and a position detector or sensor 17. The actuator lever 16 is configured to move in response to the presence or absence of a sheet held in the holding portion 11A of the sheet supply cassette 11. The position sensor 17 is configured to detect the position or state of the actuator lever 16.

Figure 4:
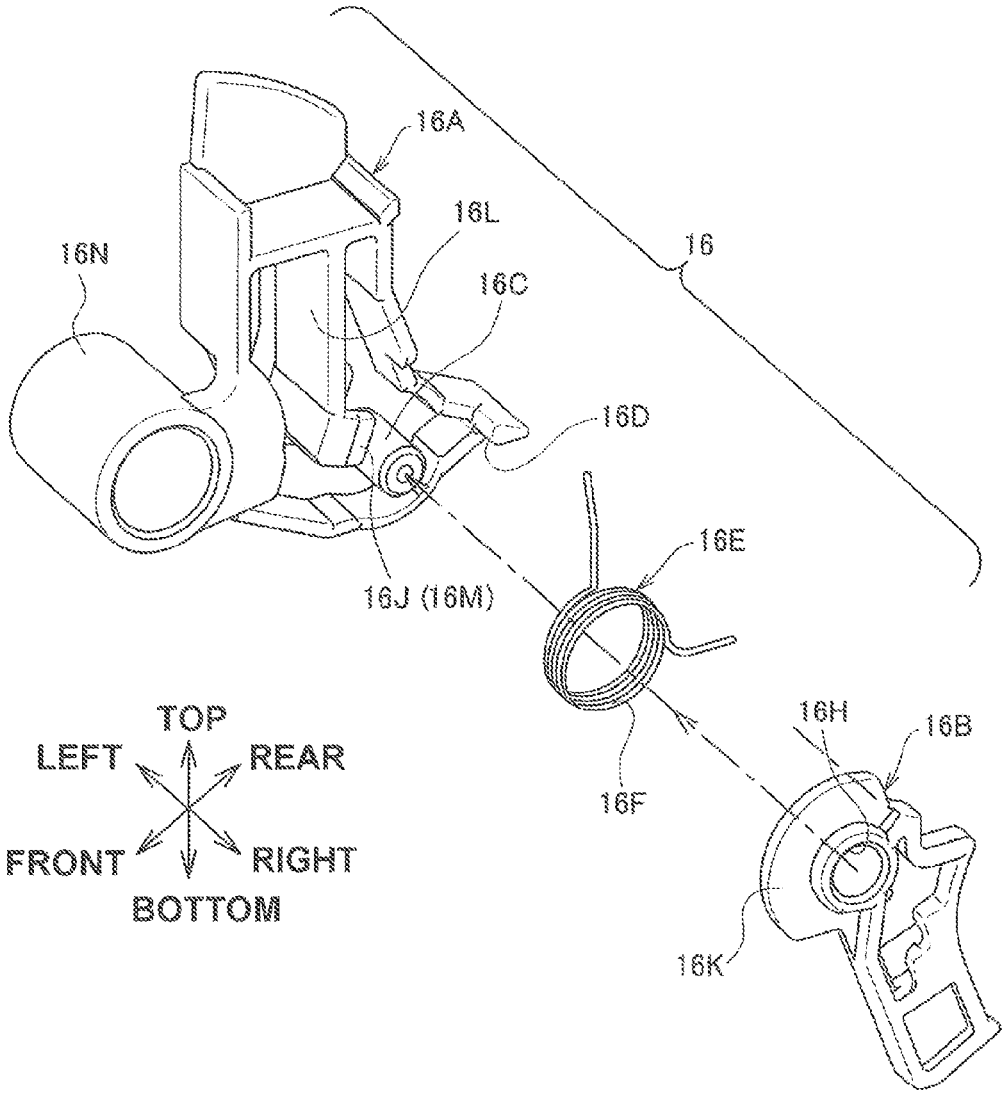
FIG. 4 is an exploded perspective view of the actuator.

As shown in FIG. 4, the actuator lever 16 is formed of resin and includes a base portion 16A and a movable portion 16B. The base portion 16A is pivotally attached to the shaft 13C which drives the separation roller 13B. The movable portion 16B is pivotally attached to the base portion 16A and extends toward the sheet supply cassette 11.

As shown in FIG. 3B, the base portion 16A integrally includes a bearing portion 16N, which receives the shaft 13C rotatably. The actuator lever 16 is supported at the bearing portion 16N. The base portion 16A of the actuator lever 16 is pivotally attached to the apparatus body 1A via the shaft 13C serving as a pivot shaft.

As shown in FIGS. 3A and 4, the base portion 16A integrally includes a pivot shaft 16C. The pivot shaft 16C is disposed at a position shifted from the bearing portion 16N or the shaft 13C in the cassette attachment direction or rearward in this illustrative embodiment.

The base portion 16A integrally includes a stopper 16D at a position shifted from the pivot shaft 16C in the cassette attachment direction or rearward. The stopper 16D is configured to contact the movable portion 16B and prevent the movable portion 16B from pivoting in the cassette attachment direction with respect to the base portion 16A.

The movable portion 16B receives, from a spring 16E (FIG. 4), an elastic force, which is exerted in a direction to increase a contact pressure between the movable portion 16B and the stopper 16D. The elastic force of the spring 16E produces a moment around the pivot shaft 16C, which acts on the movable portion 16B. In addition, the elastic force of the spring 16E is set such as to be greater than a force caused by gravity which acts on the movable portion 16B, which is hereinafter referred to as a gravity moment, and to have such a size that produces a moment having a direction opposite to that of the gravity moment, which is hereinafter referred to as a spring moment.

Figure 5:
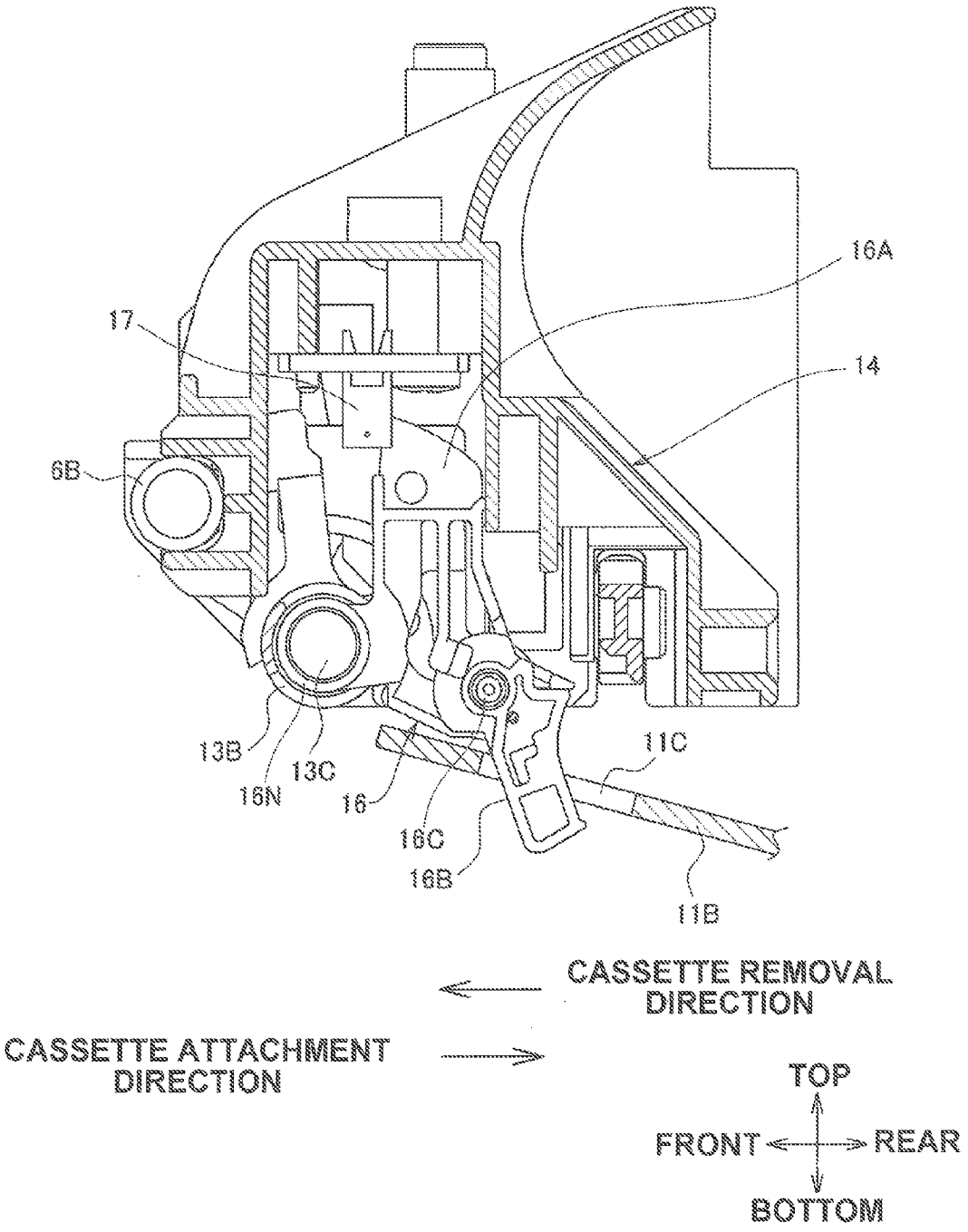
FIGS. 5, 6, and 7 are cross sectional views taken along the line A-A of FIG. 2, illustrating an operation of the actuator according to illustrative aspects of the disclosure.
Figure 6:
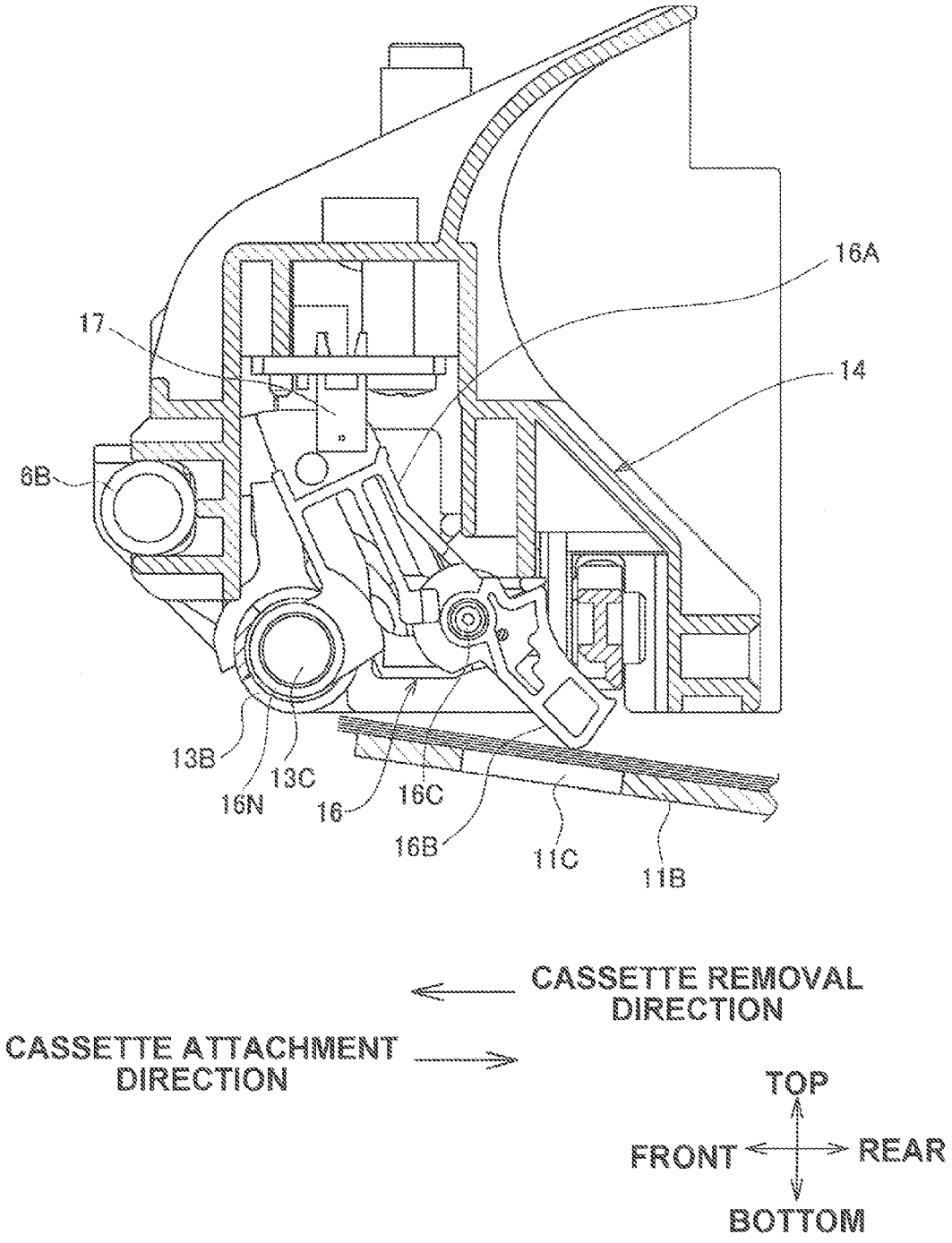

When the movable portion 16B is not subjected to a great force, in other words, when the actuator lever 16 pivots to detect the presence or absence of the sheet, as shown in FIGS. 5 and 6, the base portion 16A and the movable portion 16B pivotally move together.

Figure 7:
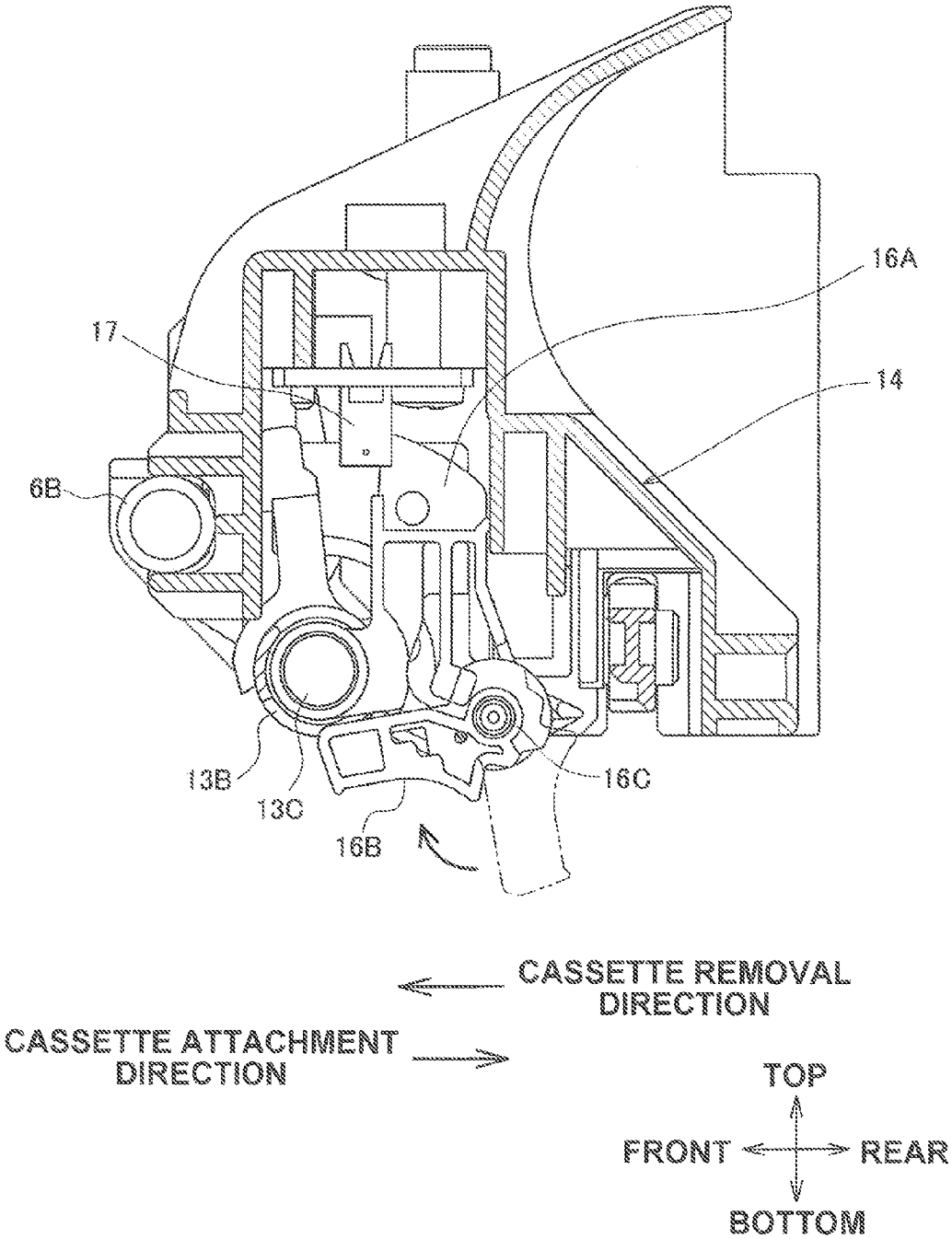

When the movable portion 16B is subjected to a moment that is greater than the spring moment and opposite in direction to the spring moment, as shown in FIG. 7, the movable portion 16B pivots on the pivot shaft 16C in the cassette removal direction or toward the front in this illustrative embodiment.

As shown in FIGS. 5 and 6, the bearing portion 16N and the pivot shaft 16C are disposed above the sheet supply cassette 11 regardless of the state of the base portion 16A of the actuator lever 16. In other words, the bearing portion 16N and the pivot shaft 16C do not interfere with the sheet supply cassette 11 while the sheet supply cassette 11 is removed from or attached to the apparatus body 1A.

As shown in FIG. 3B, the base portion 16A has a dimension W1 which is parallel to the width direction or the right-left direction, while the movable portion 16B has a dimension W2 which is parallel to the width direction. The dimension W1 of the base portion 16A is set to be greater than the dimension W2 of the movable portion 16B.

As shown in FIG. 4, the spring 16E, e.g. a coil spring, is accommodated in the base portion 16A with a coil portion 16F of the spring 16E fitted around the pivot shaft 16C. The spring 16E may not be entirely accommodated in the base portion 16A, as long as it falls within the contour of the base portion 16A.

The position sensor 17 is constituted as a transparent-type photo sensor having a light emitter and a light receiver. As shown in FIGS. 3A and 3B, the base portion 16A is provided with a light shield portion 16G. The light shield portion 16G is configured to move or pivot between a position blocking a light path L from the light emitter to the light receiver as shown in FIG. 3B and a position releasing the light path L.

The position sensor 17 may issue an off signal when the light receiver receives light from the light emitter and an on signal when the light receiver does not receive light. In this illustrative embodiment, the image forming apparatus 1 determines the position of the base portion 16A of the actuator lever 16, that is, the presence or absence of a recording sheet, based on whether either an on or off signal has been issued from the position sensor 17.

Figure 8A:
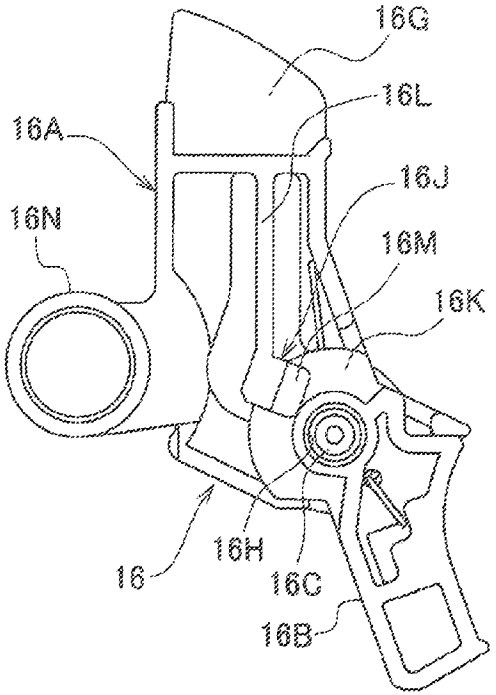
FIGS. 8A, 8B, and 8C illustrate movement of a movable portion of the actuator according to illustrative aspects of the disclosure.
Figure 8B:
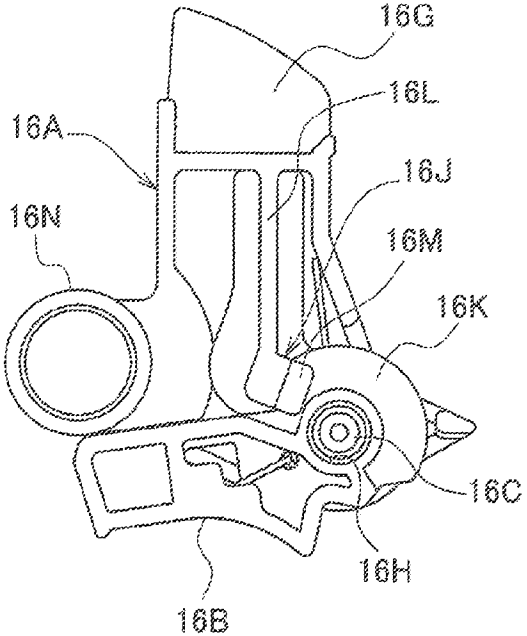
Figure 8C:
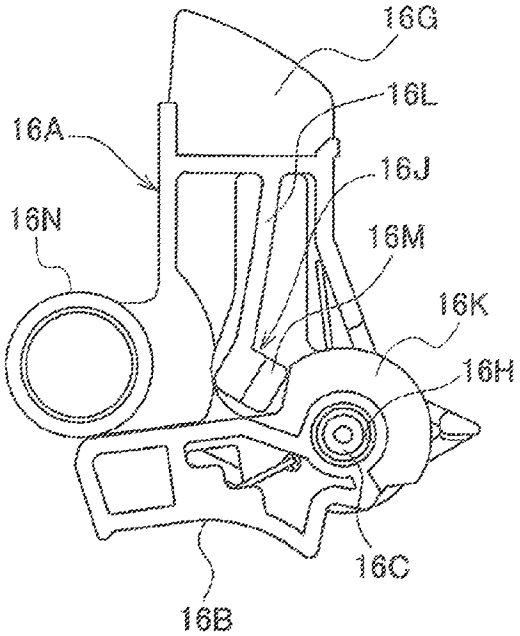

As shown in FIG. 4, the movable portion 16B includes a shaft hole 16H in which the pivot shaft 16C is inserted, and a fan-shaped flange portion 16K which is formed around the shaft hole 16H. The base portion 16A includes an arm portion 16L having a protrusion 16J at a distal end. As shown in FIGS. 8A and 8B, the flange portion 16K is configured to slidably contact the protrusion 16J of the base portion 16A. Thus, the movable portion 16B is allowed to pivot with respect to the base portion 16A while the protrusion 16J and the flange portion 16K contact each other.

As shown in FIG. 4, the arm portion 16L has a width greater than its thickness, and is shaped like a leaf spring extending in a direction perpendicular to the axial direction of the pivot shaft 16C.

With this structure, the arm portion 16L is easily deformable in a direction moving toward and away from the pivot shaft 16C in a radial direction thereof, but is resistant to deformation in a direction parallel to the axial direction of the pivot shaft 16C.

The protrusion 16J protrudes from the distal end of the arm portion 16L toward the pivot shaft 16C, and is formed with a taper portion 16M on an opposite surface to the flange portion 16K. The taper portion 16M is formed such that a distance to the flange portion 16K gradually decreases toward its distal end or toward the pivot shaft 16C.

When the movable portion 16B is pressed toward the base portion 16A with the pivot shaft 16C inserted into the shaft hole 16H, the flange portion 16K and the taper portion 16M contact each other and a force having a direction to separate the arm 16L from the pivot shaft 16C acts on the arm portion 16L. In this manner, the movable portion 16B can be easily coupled to the base portion 16A.

When the movable portion 16B is not subjected to a great force, or when the actuator lever 16 pivots to detect the presence or absence of a sheet, the base portion 16A and the movable portion 16B pivot together on the shaft 13C as described above.

In this illustrative embodiment, the pressing plate 11B presses a sheet in the sheet supply cassette 11 toward the pickup roller 12 as described above. As shown in FIG. 6, when there is at least one sheet in the sheet supply cassette 11, a distal end of the movable portion 16B contacts the sheet, the actuator lever 16 pivots in the direction away from the sheet cassette 11, e.g. upward in this illustrative embodiment, and is held in position.

The pressing plate 11B is formed with a hole 11C at a position corresponding to the actuator lever 16. After all sheets stored in the sheet cassette supply 11 are fed, the pressing plate 11B remains as it has ascended toward the pickup roller 12, whereas the actuator lever 16 pivotally moves downward such that the movable portion 16B enters the hole 11C due to moment caused by its own weight and approaches the sheet supply cassette 11 as shown in FIG. 5.

In this illustrative embodiment, the position sensor 17 issues an on signal when there is a sheet as shown in FIG. 6, and an off signal when there is no sheet as shown in FIG. 5.

When the sheet supply cassette 11 is removed from the apparatus body 1A, if a part of the sheet supply cassette 11 contacts the actuator lever 16, the actuator lever 16 is subjected to the moment that is greater than the spring moment and opposite in direction to the spring moment. Thus, as shown in FIG. 7, the movable portion 16B pivots on the pivot shaft 16C toward the front or in the cassette removal direction.

When the sheet supply cassette 11 is removed from the apparatus body 1A, even if the actuator lever 16 and the sheet supply cassette 11 interfere or collide with each other, the movable portion 16B pivots as shown in FIG. 7, thereby absorbing the collision. Thus, damage to the actuator lever 16 may be reduced.

Thus, there is no need to provide the actuator lever 16 with the formation of a guide surface inclined in the cassette removal direction. As the actuator lever 16 is structurally different from the related art, potential for damage to the actuator lever 16 may be reduced and the need to increase the physical size of the sheet feeder 10 may be minimized.

In the illustrative embodiment, the sheet supply cassette 11 is formed with the hole 11C to minimize a chance of interference between the sheet supply cassette 11 and the actuator lever 16 when the sheet supply cassette 11 is removed. Thus, the sheet supply cassette 11 and the actuator lever 16 do not interfere with each other in principle when the sheet supply cassette 11 is removed.

If the sheet supply cassette 11 is forcibly removed while remaining inclined in the cassette removal direction, the actuator lever 16 and the sheet supply cassette 11 may interfere with each other as described above.

However, as the bearing portion 16N and the pivot shaft 16C are arranged above the sheet supply cassette 11, the base portion 16A and the sheet supply cassette 11 do not contact each other when the sheet supply cassette 11 is removed.

With this arrangement, even if the sheet supply cassette 11 is forcefully removed while remaining inclined in the cassette removal direction, the potential for damage to the actuator lever 16 may be minimized.

In the illustrative embodiment, when the sheet supply cassette 11 changes from a state having a sheet therein shown in FIG. 6 to a state having no sheet therein shown in FIG. 5, the base portion 16A pivotally moves such that the distal end of the movable portion 16B approaches the sheet supply cassette 11.

In this illustrative embodiment, when the sheet supply cassette 11 changes from the state having a sheet therein to the state having no sheet therein, the base portion 16A and the movable portion 16B pivotally move such that the distal end of the movable portion 16B approaches the sheet supply cassette 11. When there is a sheet in the sheet supply cassette 11, the base portion 16A and the movable portion 16B are positioned such that the distal end of the movable portion 16B pivots in the direction away from the sheet supply cassette 11, e.g. upward in this illustrative embodiment, and is held in position.

In other words, as shown in FIGS. 5-7, a direction that the actuator lever 16 pivots to detect the presence of a sheet (e.g. the cassette attachment direction in this embodiment) is different from a direction that the movable portion 16B pivots when the actuator lever 16 the sheet supply cassette 11 interfere or collide with each other (e.g. the cassette removal direction in this embodiment).

Thus, when the actuator lever 16 pivots to detect the presence or absence of the sheet, the movable portion 16B hardly pivots by accident, and the actuator lever 16 can reliably detect the presence or absence of the sheet.

In this illustrative embodiment, the base portion 16A includes the stopper 16D which is configured to contact the movable portion 16B and reduce the potential for the movable portion 16B from pivoting in the cassette attachment direction with respect to the base portion 16A. When the presence or absence of the sheet is detected, the base portion 16A and the movable portion 16B can integrally pivot.

In this illustrative embodiment, the actuator lever 16 includes the spring 16E which is configured to give the movable portion 16B an elastic force, which is exerted in a direction to increase the contact pressure between the movable portion 16B and the stopper 16D. The spring 16E allows the movable portion 16B to return to and remain at a position for detecting the presence or absence of the sheet after the actuator lever 16 and the sheet supply cassette 11 interfere with each other to cause the movable portion 16B to pivot. Accordingly, the base portion 16A and the movable portion 16B can integrally pivot reliably.

In this illustrative embodiment, the dimension W1 of the base portion 16A is greater than the dimension W2 of the movable portion 16B, and the spring 16E is accommodated in the base portion 16A. Thus, the mass of the base portion 16A is greater than that of the movable portion 16B, and the base portion 16A can serve as a weight for causing the actuator lever 16 to pivot.

In the illustrative embodiment, the disclosure may be applied to, but is not limited to, an electrophotographic type image forming apparatus. The disclosure may be applied to an inkjet type image forming apparatus and other types of sheet feeding devices.

The illustrative embodiment shows, but the disclosure is not limited to, the coil spring.

The illustrative embodiment shows, but the disclosure is not limited to, a transparent type photo sensor.

The illustrative embodiment shows, but the disclosure is not limited to, that the base portion 16A and the movable portion 16B are formed of resin.

The illustrative embodiment shows, but the disclosure is not limited to, the pivot shaft 16C that is disposed at a position shifted from the bearing portion 16N or the shaft 13C in the cassette attachment direction.

The illustrative embodiment shows, but the disclosure is not limited to, that the dimension W1 of the base portion 16A is greater than the dimension W2 of the movable portion 16B and the base portion 16A accommodates the spring 16E.

The illustrative embodiment shows, but the disclosure is not limited to, the sheet feeder in which sheets are stacked vertically.

The illustrative embodiment shows, but the disclosure is not limited to, that the actuator lever 16 pivots in the front-rear direction. The actuator lever 16 may pivot in the right-left direction.

While the features herein have been described in connection with various example structures and illustrative aspects, it will be understood by those skilled in the art that other variations and modifications of the structures and aspects described above may be made without departing from the scope of the disclosure described herein. Other structures and aspects will be apparent to those skilled in the art from a consideration of the specification or practice of the features disclosed herein. It is intended that the specification and the described examples only are illustrative with the scope of the inventions being defined by the following claims.

What is claimed is:

1. A sheet feeding device for use in an apparatus body of an image forming apparatus, comprising:

a sheet holder configured to be removed from and attached to the apparatus body and to hold a stack of sheets therein, the sheet holder having an opening;

an actuator including a base portion pivotally attached to the apparatus body via a first shaft and a movable portion pivotally attached to the base portion via a second shaft and extending toward the sheet holder; and a detector configured to detect whether a sheet is being held in the sheet holder based on a position of the base portion, the base portion being configured to activate and deactivate the detector, wherein the actuator is configured such that the base portion and the movable portion pivot in response to presence or absence of a sheet being held in the sheet holder, and wherein the movable portion is configured to, when the sheet holder is removed from the apparatus body, pivot relative to the base portion to a position such that the movable portion extends from the second shaft to a sheet contact end in a removal direction in which the sheet holder is removed from the apparatus body, the movable portion is configured to contact a sheet held by the sheet holder at the sheet contact end of the movable portion and to enter the opening when no sheet is held by the sheet holder, and the movable portion is configured to pivot around the second shaft to a position in which the movable portion extends from the second shaft to the sheet contact end in an attachment direction in which the sheet holder is attached to the apparatus body, and the attachment direction is opposite to the removal direction relative to the second shaft.

2. The sheet feeding device according to claim 1, wherein the detector includes a sensor.

3. The sheet feeding device according to claim 1, wherein the second shaft is disposed at a position shifted from the first shaft in the attachment direction in which the sheet holder is attached to the apparatus body, and wherein the base portion pivotally moves such that the sheet contact end of the movable portion approaches the sheet holder when the sheet holder changes from a state having a sheet therein to a state having no sheet therein.

4. The sheet feeding device according to claim 3, further comprising a stopper provided in the base portion, the stopper being configured to contact the movable portion and restrict pivotal movement of the movable portion in the attachment direction.

5. The sheet feeding device according to claim 4, further comprising a spring configured to exert an elastic force on the movable portion in a direction to increase a contact surface between the movable portion and the stopper.

6. The sheet feeding device according to claim 5, wherein the sheet holder holds sheets stacked vertically, the first shaft and the second shaft are disposed above the sheet holder, the base portion has a dimension greater than a dimension of the movable portion with respect to a direction parallel to a width direction that is perpendicular to the removal direction, and the spring is accommodated in the base portion.

7. The sheet feeding device according to claim 1, wherein the sheet holder has a surface configured to receive a sheet thereon, wherein the surface has the opening, and wherein the base portion is disposed above the surface of the sheet holder.

8. The sheet feeding device according to claim 1, wherein the sheet holder is configured to be removed from and attached to the apparatus body horizontally.

9. An image forming apparatus comprising:

an apparatus body;

a sheet feeder comprising:

a sheet holder configured to be removed from and attached to the apparatus body and to hold a stack of sheets therein, the sheet holder having an opening;

an actuator including a base portion pivotally attached to the apparatus body via a first shaft and a movable portion pivotally attached to the base portion via a second shaft and extending toward the sheet holder; and a detector configured to detect whether a sheet is being held in the sheet holder based on a position of the base portion, the base portion being configured to activate and deactivate the detector, wherein the actuator is configured such that the base portion and the movable portion pivot in response to presence or absence of a sheet being held in the sheet holder; and an image forming unit configured to form an image on a sheet fed by the sheet feeder, wherein the movable portion is configured to, when the sheet holder is removed from the apparatus body, pivot relative to the base portion to a position such that the movable portion extends from the second shaft to a sheet contact end in a removal direction in which the sheet holder is removed from the apparatus body, the movable portion is configured to contact a sheet held by the sheet holder at the sheet contact end of the movable portion and to enter the opening when no sheet is held by the sheet holder, and the movable portion is configured to pivot around the second shaft to a position in which the movable portion extends from the second shaft to the sheet contact end in an attachment direction in which the sheet holder is attached to the apparatus body, and the attachment direction is opposite to the removal direction relative to the second shaft.

10. The image forming apparatus according to claim 9, wherein the detector includes a sensor.

11. The image forming apparatus according to claim 9, wherein the second shaft is disposed at a position shifted from the first shaft in the attachment direction in which the sheet holder is attached to the apparatus body, and wherein the base portion pivotally moves such that the sheet contact end of the movable portion approaches the sheet holder when the sheet holder changes from a state having a sheet therein to a state having no sheet therein.

12. The image forming apparatus according to claim 11, further comprising a stopper provided in the base portion, the stopper being configured to contact the movable portion and restrict pivotal movement of the movable portion in the attachment direction.

13. The image forming apparatus according to claim 12, further comprising a spring configured to exert an elastic force on the movable portion in a direction to increase a contact surface between the movable portion and the stopper.

14. The image forming apparatus according to claim 13, wherein the sheet holder holds sheets stacked vertically, the first shaft and the second shaft are disposed above the sheet holder, the base portion has a dimension greater than a dimension of the movable portion with respect to a direction parallel to a width direction that is perpendicular to the removal direction, and the spring is accommodated in the base portion.

15. The image forming apparatus according to claim 9, wherein the sheet holder has a surface configured to receive a sheet thereon, wherein the surface has the opening, and wherein the base portion is disposed above the surface of the sheet holder.

16. The image forming apparatus according to claim 9, wherein the sheet holder is configured to be removed from and attached to the apparatus body horizontally.

17. A sheet feeding device for use in an apparatus body of an image forming apparatus, comprising:

a sheet holder configured to be removed from and attached to the apparatus body and to hold a stack of sheets therein, the sheet holder having a surface configured to receive a sheet thereon, the surface having an opening;

an actuator including a base portion pivotally attached to the apparatus body via a first shaft and a movable portion pivotally attached to the base portion via a second shaft and extending toward the sheet holder, the base portion being disposed above the surface of the sheet holder; and a detector configured to detect whether a sheet is being received on the surface of the sheet holder based on a position of the base portion, wherein the actuator is configured such that the base portion and the movable portion pivot in response to presence or absence of a sheet being received on the surface of the sheet holder, and wherein the movable portion is configured to, when the sheet holder is removed from the apparatus body, pivot relative to the base portion to a position such that the movable portion extends from the second shaft to a sheet contact end in a removal direction in which the sheet holder is removed from the apparatus body, the movable portion is configured to contact a sheet held by the sheet holder at the sheet contact end of the movable portion and to enter the opening when no sheet is held by the sheet holder, and the movable portion is configured to pivot around the second shaft to a position in which the movable portion extends from the second shaft to the sheet contact end in an attachment direction in which the sheet holder is attached to the apparatus body, and the attachment direction is opposite to the removal direction relative to the second shaft.

18. The sheet feeding device according to claim 17, wherein the base portion is configured to activate and deactivate the detector.

19. The sheet feeding device according to claim 17, wherein the sheet holder is configured to be removed from and attached to the apparatus body horizontally.

* * * * *